US009005009B2

(12) United States Patent
Salazar et al.

(10) Patent No.: US 9,005,009 B2
(45) Date of Patent: Apr. 14, 2015

(54) WAGERING GAME, GAMING MACHINE, NETWORKED GAMING SYSTEM AND METHOD WITH A PLAYER-SELECTABLE MULTI-GAME MIX AND MATCH FEATURE

(71) Applicant: Multimedia Games, Inc., Austin, TX (US)

(72) Inventors: Juan Felipe Salazar, Austin, TX (US); Bradley W. Johnson, Austin, TX (US); Allison L. Pope, Austin, TX (US); Brian A. Watkins, Austin, TX (US); Clint Owen, Austin, TX (US); JP Cody, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 196 days.

(21) Appl. No.: 13/625,433

(22) Filed: Sep. 24, 2012

(65) Prior Publication Data

US 2013/0072278 A1 Mar. 21, 2013

Related U.S. Application Data

(63) Continuation-in-part of application No. 13/221,819, filed on Aug. 30, 2011, now Pat. No. 8,608,546.

(60) Provisional application No. 61/413,433, filed on Nov. 13, 2010.

(51) Int. Cl.
*G07F 17/32* (2006.01)

(52) U.S. Cl.
CPC ..... *G07F 17/3262* (2013.01)

(58) Field of Classification Search
CPC ..... G07F 17/32; G07F 17/34; G07F 17/3262; G07F 17/3267; A63F 9/0468
USPC ..... 463/18, 20, 22
See application file for complete search history.

(56) References Cited

U.S. PATENT DOCUMENTS

| | | | | |
|---|---|---|---|---|
| 6,869,361 | B2 | 3/2005 | Sharpless et al. | |
| 6,984,174 | B2 | 1/2006 | Cannon et al. | |
| 7,753,777 | B1 | 7/2010 | Giuffria et al. | |
| 7,922,579 | B2 | 4/2011 | Walker et al. | |
| 8,070,587 | B2 * | 12/2011 | Davis et al. | 463/20 |
| 8,152,632 | B2 | 4/2012 | Fong | |
| 8,187,089 | B2 | 5/2012 | Englman et al. | |
| 2004/0152503 | A1 | 8/2004 | Lind et al. | |
| 2008/0045295 | A1 | 2/2008 | Walker et al. | |
| 2009/0197659 | A1 | 8/2009 | Christensen | |
| 2010/0240436 | A1 | 9/2010 | Wilson et al. | |
| 2011/0105218 | A1 | 5/2011 | Anderson et al. | |
| 2012/0094739 | A1 | 4/2012 | Louie | |

* cited by examiner

*Primary Examiner* — Pierre E Elisca
(74) *Attorney, Agent, or Firm* — JP Cody, Esq.; Russell D. Culbertson, Esq.

(57) ABSTRACT

A system, apparatus, and method are disclosed in which a gaming machine provides a player-selectable base game and a player-selectable side game, both of which may be played and wagered upon concurrently or according to some play sequence. The selected base game may be one of several themes or types of game displayed on a portion of a primary display of the gaming machine and the selected side game may be one of several themes or types of game displayed on a remaining portion of the primary or an alternate display. The potential prizes may be stand-alone as with a prize table or networked as with a prize pool having fixed or progressive prizes.

19 Claims, 7 Drawing Sheets

WAGERING GAME, GAMING MACHINE, NETWORKED GAMING SYSTEM AND METHOD WITH A PLAYER-SELECTABLE MULTI-GAME MIX AND MATCH FEATURE

CROSS-REFERENCE TO RELATED APPLICATION

This application is a continuation-in-part of co-pending U.S. Non-Provisional patent application Ser. No. 13/221,819 filed Aug. 30, 2011 and entitled "WAGERING GAME, GAMING MACHINE, NETWORKED GAMING SYSTEM AND METHOD WITH A SIMULTANEOUS SECONDARY GAME" which claims the benefit, under 35 U.S.C. §119(e), of U.S. Provisional Patent Application No. 61/413,433 filed Nov. 13, 2010, and entitled "Wagering Game, Gaming Machine, Networked Gaming System And Method With A Simultaneous Secondary Game."

The entire content of these applications are incorporated herein by this reference.

COPY RIGHT NOTICE

A portion of the disclosure of this patent document contains material which is subject to copyright protection. The copyright owner has no objection to the facsimile reproduction of the patent document or the patent disclosure as it appears in the U.S. Patent and Trademark. Office patent files or records, but otherwise reserves all rights of copyright whatsoever.

BACKGROUND OF THE INVENTION

1. Field of the Invention

This invention relates to wagering games, gaming machines, networked gaming systems and associated methods. More particularly, the invention relates to wagering games, gaming devices, networked gaining systems, and associated methods including player selectable, simultaneously operable and distinct primary and secondary games.

2. Description of the Related Art

A large number of different gaming machines have been developed to provide various formats and graphic presentations for conducting wagering games and presenting wagering game results.

There continues to be a need for wagering games which maintain the player's interest and generate excitement to enhance the player's gaming experience.

SUMMARY OF THE INVENTION

In accordance with one or more embodiments, wagering games, gaming machines, networked gaming systems and methods include a player-selectable base game and a player-selectable side game, both of which may be played and wagered upon concurrently or according to some play sequence. The selected base game may be one of several themes or types of game displayed on a portion of a primary display of the gaming machine and the selected side game may be one of several themes or types of game displayed on a remaining portion of the primary or an alternate display. The potential prizes may be stand-alone as with a prize table or networked as with a prize pool having fixed or progressive prizes.

These and other features of the invention will be apparent from the following description of the illustrative embodiments, considered along with the accompanying drawings.

DESCRIPTION OF ILLUSTRATIVE EMBODIMENTS

Figure 1:
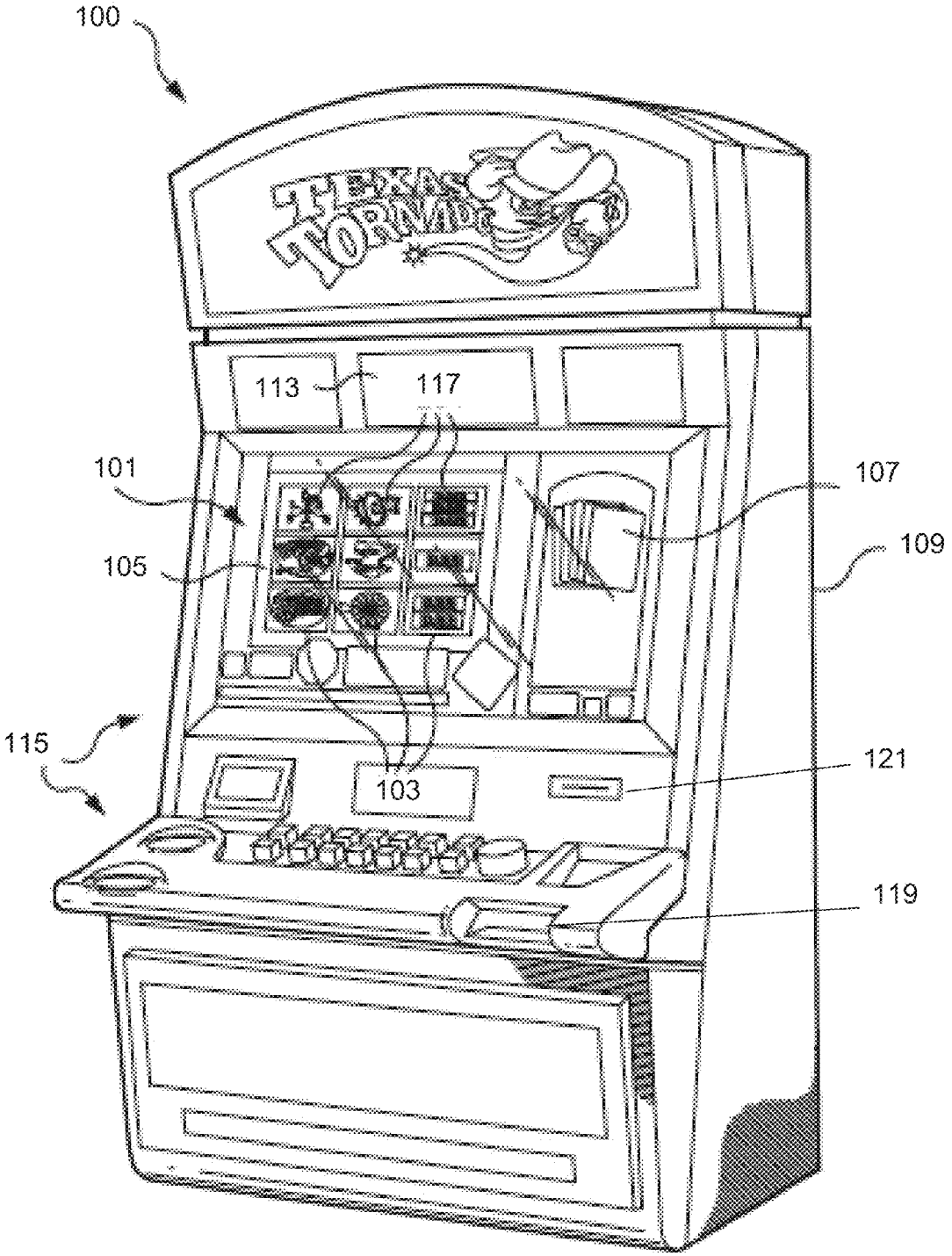
FIG. 1 is a front perspective view of an example upright gaming machine wherein a player selected base game and player selected side game are displayed, according to one or more embodiments.

Referring to FIG. 1, gaming machine 100 is shown including primary display device 101 with which a set of reels 103 for a player selected primary (base) game are shown or displayed in a primary game display area 105 and a player selected side (secondary) game is shown displayed in a side game display area in accordance with one or more embodiments.

Figure 2A:
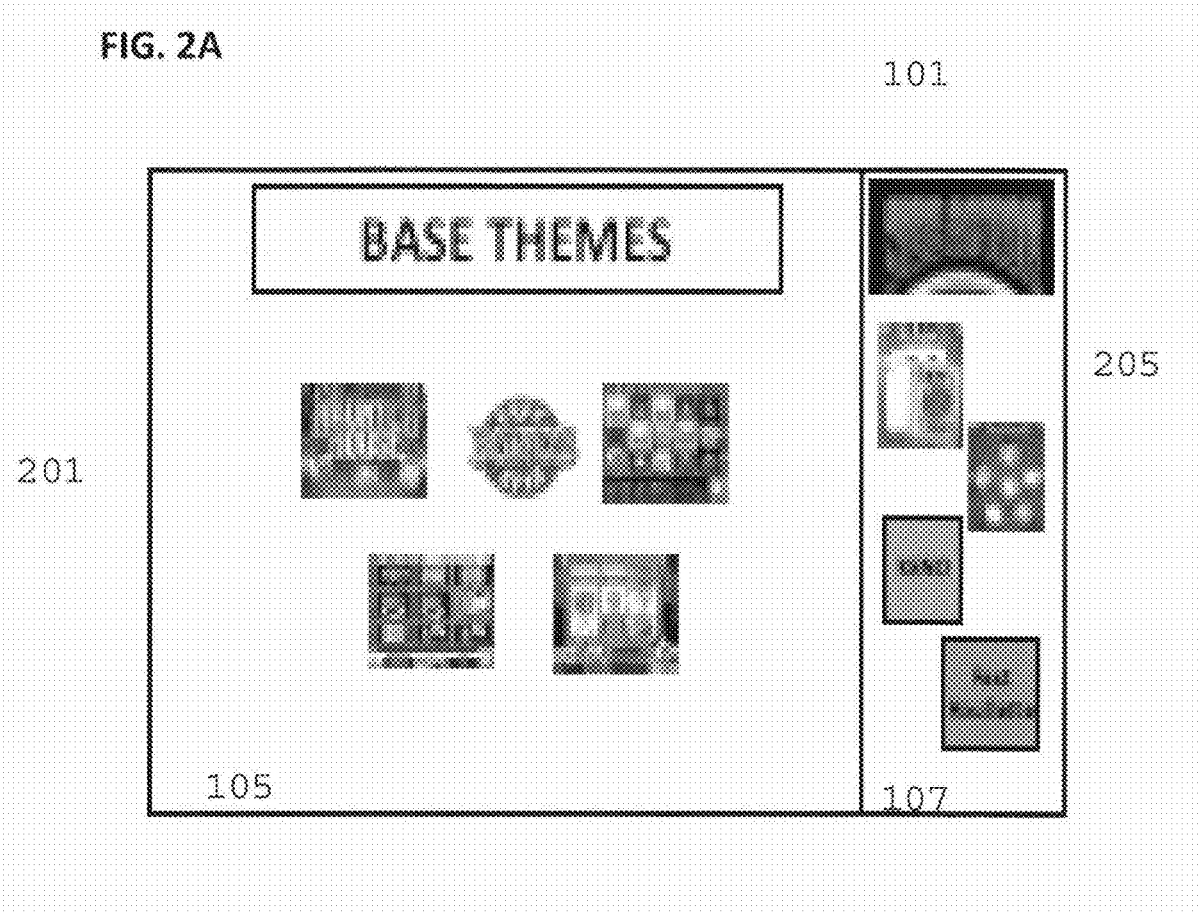
FIG. 2A is an example primary display screenshot wherein a set of selectable primary, games are shown in a base game display area and a set of selectable side games are shown in a side game display area in accordance with one or more embodiments.
Figure 2B:
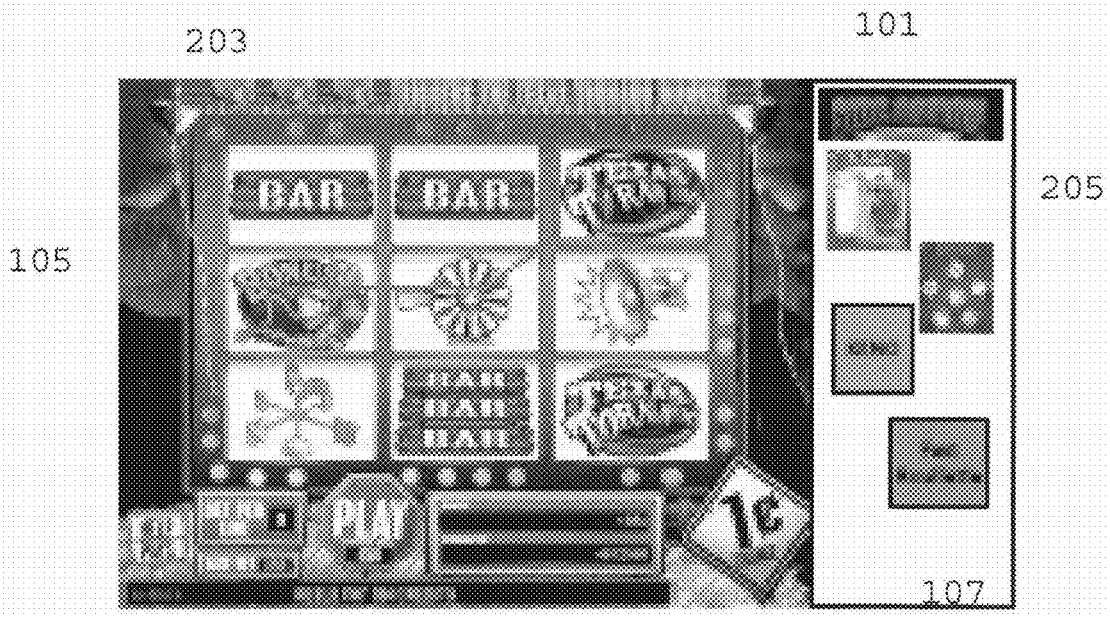
FIG. 2B is an example primary display screenshot wherein a player selected primary game is shown in a base game display area and a set of selectable side games are shown in a side game display area in accordance with one or more embodiments.

In one or more embodiments, a set of activate-able primary game icon images may be displayed in the primary game area where the display may include a touch sensitive panel enabling a player to select one of the primary game icons by pressing the panel (screen) overlaying the respective primary game icon image. As may be seen in FIG. 2A wherein an example screenshot shows primary display device 101 with primary game display area 105 including a set of primary game icons 201; and FIG. 2B shows a subsequent example screenshot of primary display device 101 wherein primary game display area 105 shows the player-selected primary game 203 which is displayed by the game processor responsive to the player's selection of the respective icon on the preceding screen shot (FIG. 2A). The player's selection may by pressing a respective display area associated with an icon in the case where the display is touch-sensitive; in the case where the display is not touch sensitive, then a set of indicator buttons may be programmed to display such as on a touch sensitive user interface button deck or button deck with programmable buttons. An example set of primary game icons 201 may include various multi-reel games including single line and multi-line games (such as Multimedia Games' Haunted House, Texas Tornado), card games including multi-hand poker (such as IGT's Triple Play), roulette, (such as Bally's Roulette game), and/or blackjack including multi-hand blackjack (such as Bally's Multi-Play Blackjack). Once a primary game is selected, an associated paytable may be displayed, various outcomes determined, for each game play, and payouts made by the game processor for any winning outcomes in accordance with the associated paytable.

Figure 2C:
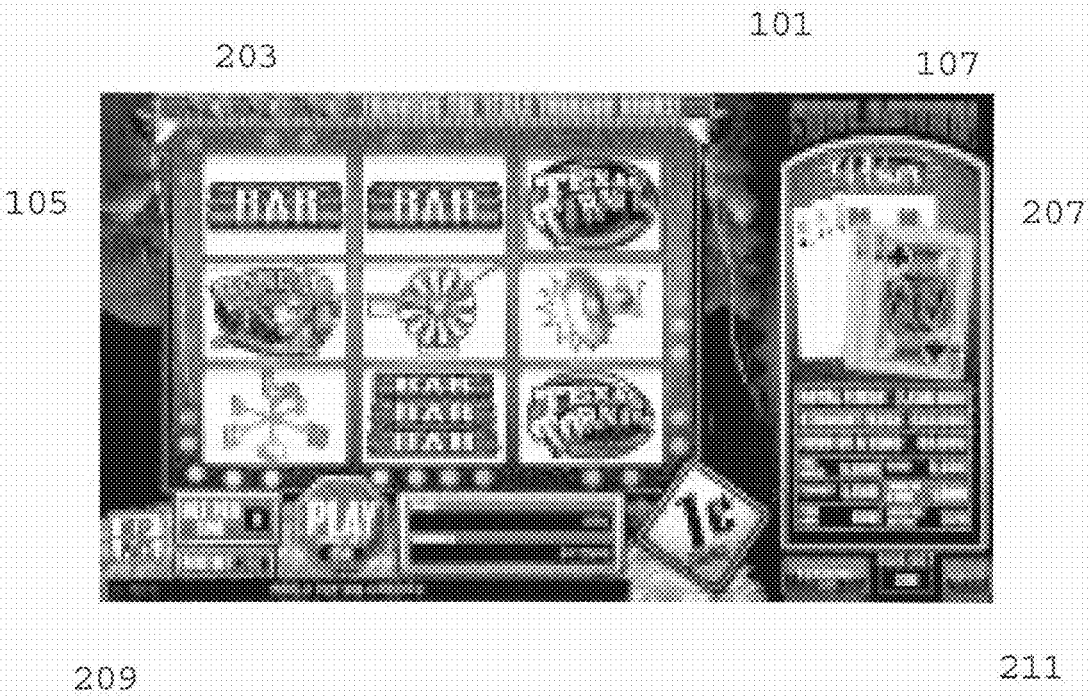
FIG. 2C is an example primary display screenshot wherein a player selected primary game is shown in a base game display area and a player selected side game is shown in a side game display area in accordance with one or more embodiments.

Additionally, a set of activate-able side (secondary) game icon images may be displayed in the side game area enabling the player to select one of the side game icons by pressing the panel (screen; overlaying the respective side game icon image. As may be seen in FIG. 2A wherein an example screenshot shows primary display device 101 with side game display area. 107 including a set of side game icons 205; and FIG. 2B shows a subsequent example screenshot of primary display device 101 wherein primary game display area 105 shows the player-selected primary game 203 which is displayed by the game processor responsive to the player's selection of the respective icon on the preceding screen shot and side game display area 107 continues to show the set of side game icons 205; and, FIG. 2C shows a subsequent example screenshot of primary display device 101 wherein primary game display area 105 shows the player-selected primary game 203 and the player-selected side game 207 which are displayed by the game processor responsive to the player's selection of the respective icons as shown in the preceding screen shots of FIGS. 2A and 2B. An example set of side game icons 201 may include various multi-reel games including single line games, dice, poker, keno, and/or roulette. Once a primary-game is selected, an associated paytable may be displayed, various outcomes determined for each game play, and payouts made by the game processor for any winning outcomes in accordance with the associated paytable.

In one or more embodiments, a default base and/or side game or randomly selected base and/or side game may be displayed if a player initiates game play with a wager without selecting a base and side game. In one or more embodiments, once a player selects a base and/or side game during a first gaming session, upon ending the gaining session, a transmission may be initiated by the game processor sending the base and/or side game information to a server, such as player tracking server 409, for storage in association with the player's account; then, when the player identifies themself during a subsequent gaming session, such as: by inserting the player's card into card reader 121, gaming machine 100 may transmit a message to the player tracking server 409 identifying the player, receive player information including information about the prior session primary & side game selections, if any, and automatically display the prior selected base and/or side game. In an alternative to an automatic display of the prior selected base and/or side games, the player may be prompted, such as by a pop up message on the primary display device 101 or display 123, with a displayed question "Change the previous settings?" or "Retain the previous settings?" The display may be touch sensitive or have selector buttons about the perimeter associable with menu items, such as 'Yes' and/or 'No'. In another alternative, the button deck of user interface 115 may be programmed to display player query and answer button areas.

In one or more embodiments, the server for storing persistent player information may be a manufacturer, vendor, or sponsor's server, for example gaming website 421 may be operated by Multimedia Games and Multimedia Games gaming machines or others with applicable software may communicate with website 421 to provide player information including the player's game selection so that when the player returns for a subsequent session, the player may be prompted as to whether he would like the previous game preferences initiated. For example, when a player initiates a selection, the game processor may send the information to a network controller for transmission to website 421. After the gaming session ends and the player returns for a subsequent gaming session, the players preferences may either automatically download when the player identifies themself or may be made available for download, such as through a pop up window that may ask if the player would like their prior preferences initiated on the respective gaming device, if available.

Figure 3A:
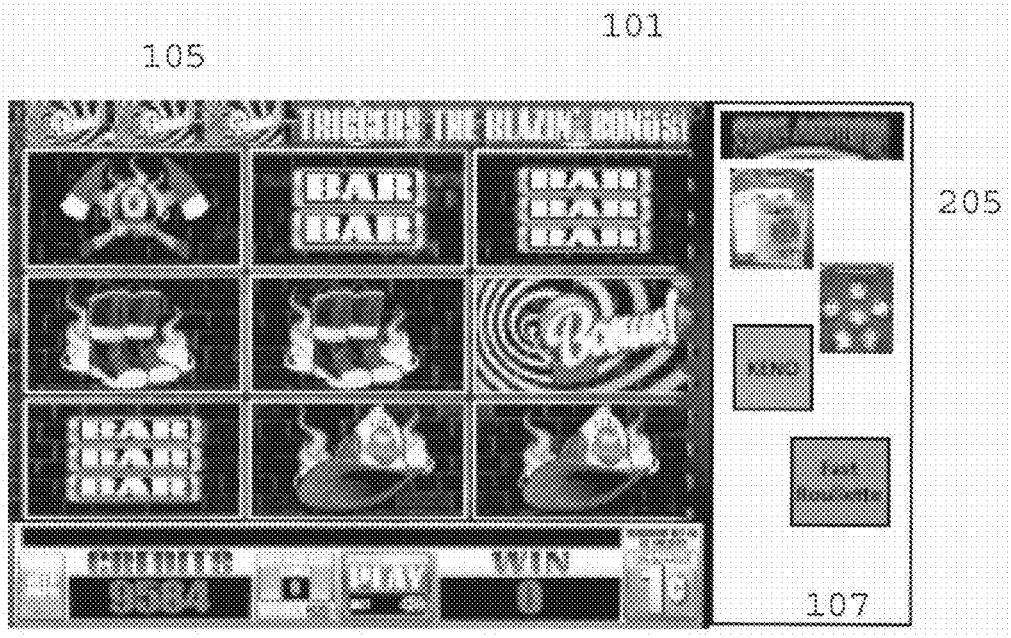
FIG. 3A is an example primary display screenshot wherein a non-selectable primary game is shown in a base game display area and a set of selectable side games are shown in a side game display area in accordance with one or more embodiments.
Figure 3B:
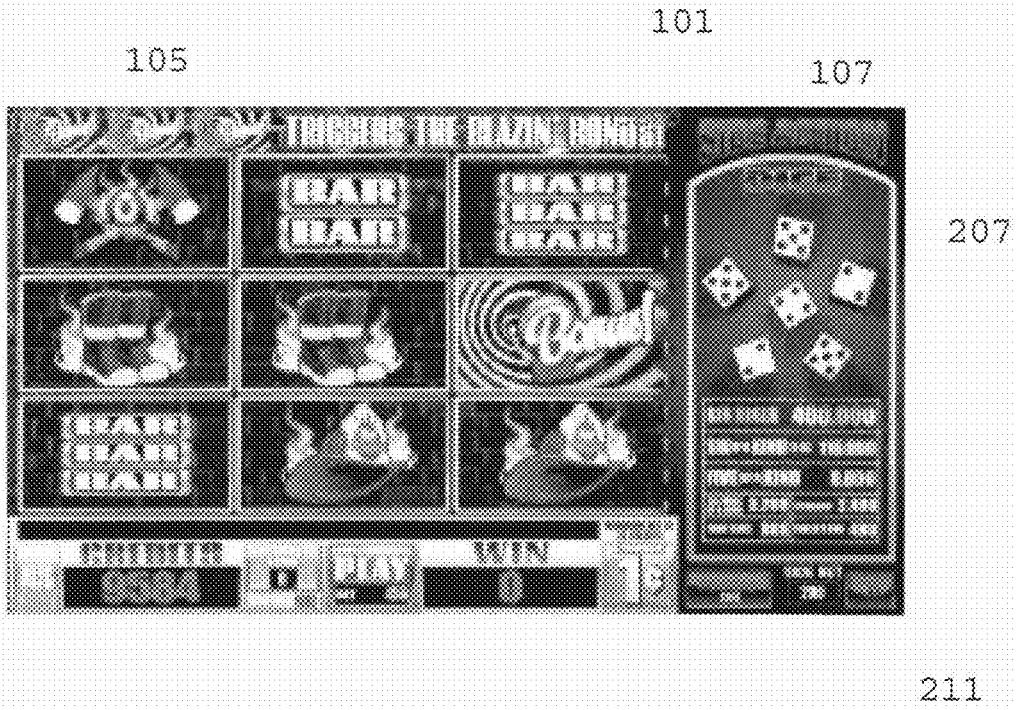
FIG. 3B is an example primary display screenshot wherein a non-selectable primary game is shown in a base game display area and a player selected side game is shown in a side-game display area in accordance with one or more embodiments.

In one or more embodiments, in addition to the selectable game icons, selectable primary game set menu button 209 and selectable side game set menu button 211 may be positioned (such as shown in FIG. 2C and FIG. 3B) and enabled to provide the player an option to return to one or more of the display settings such as shown in FIGS. 2A, 2B, 3A whereon the set of primary game icons 201 and/or the set of side game icons 205 may be re-shown to allow a player to elect to re-select a primary and/or side game to play.

An alternate embodiment is shown in FIGS. 3A and 3B wherein only the side game 207 is selectable from a set of side game icons 205.

In one or more alternate embodiments, the set of primary game icons 201 and/or the set of side game icons 205 may be displayed on one of the alternate displays available, such as display 123, or if the button deck is itself a display, which may show either a menu request button, such as described with respect to menu buttons 209, 211, or the set of primary game icons 201 and/or the set of side game icons 205 sized and proportioned to accommodate the size of the display area. For example, the sets of icons may be miniaturized on a touch screen display whereon a player may tap and/or slide a portion of the display area to expand one or more of the miniaturized sets of icons to enable the player to select-one of the same icons and cause the game processor to display the respective selected game on the primary display 101.

In one or more embodiments, one or more base and/or side games may be selectable to play simultaneously. In which case, several, windows may be added to primary game display 101 with the respective side game/s being played concurrently with the base game/s. Once the number of base games and side games has been selected by the player, then the button deck may be modified by the game processor to display the corresponding wager amounts for the base and side games, and the respective paytables may be displayed either through a Help screen when requested by a player or the game processor may cause the paytables to be displayed on a display above display 101 (not shown). Once the game outcomes for each of the played games have been displayed, the game processor may sequentially cause the paytables for each of the played games to be highlighted as the winning outcomes are paid by the game processor; also, the winning paylines may be highlighted synchronously with the respective paytable.

In an example embodiment, a player may initiate the base game and the side game with either one or two wagers. In the case of a base and side game that is activated by a single wager, a player may select the number of lines and credits per line in order to make a wager on the base game; and when the player initiates game play, outcomes on both the base and side game are determined. In one or more embodiments, an additional wager may be required to initiate the side game; for example, the primary game wager may be thirty credits and the side game may be an additional twenty-five credits.

While conceptually, reel games, dice, keno, card games, and roulette are shown in side game display 107, any game opportunity artifice may be used; for example, a lottery or sweepstakes-style game.

In one or more embodiments, the side game may be self-contained on gaming machine 100 such that game outcomes are generated by the game processor or a processor with executable coding to randomly or pseudo-randomly generate each of the game outcomes, compare the game outcome/s with a paytable (or prize list) to determine whether the generated game outcome/s correspond to winning outcomes in the paytable, and pay the corresponding award/s or prize/s. The awards or prizes may be fixed or may be progressive awards which may increase as a percent or portion of the wagers.

In other embodiments, the base and/or side games may utilize network resources, such as a server with executable coding operative to generate one or more aspects of the base and/or side games. For example, when a base and side game are initiated on gaming machine 100, the game processor may transmit a message or cause a transmission through a network controller to the external server which may determine and transmit the base and side game outcomes; and upon receipt, the game processor may display one or more game presentations corresponding to the base and side game outcomes, such as on primary display device 101.

In the case of networked base and/or side games, one or more networked gaming machines 100 may participate in one or more networked base and/or side games. Multiple gaming machines 100 may connect or be connected to a server configured to execute one or more server-based games sequentially or simultaneously. For example, the server may manage and/or maintain multiple games wherein a portion of wagers and/or operator money may be utilized to fund the various different prize levels, such as progressive awards and/or lottery or sweepstake-style games, so that each of the players at the various connected gaming machines may play for opportunities to win the various prizes which may be updated and maintained through the server. In addition to offering multiple game choices, the server may simultaneously manage multiple of the same style game playable on the various gaming machines 100. When progressive prizes are won, the associated prize levels may be reset at a starting default level; in which case, the funds for the default level may be advanced of contributed by the casino operator (or casino operators in the case where the side game is networked over multiple gaming facilities).

Referring again to FIG. 1, primary display device 101 and the other components of gaming machine 100 may be mounted on or about a cabinet 109; although, in some implementations, gaining device 100 may be a portable gaming device, such as a tablet, laptop computer, or phone, network connected to a remote game processor. During primary game operation or attract mode, a base game paytable may be displayed on display 100 (or another available display) and/or may be accessed through a help button and screen, to view various base game winning outcomes associated with various awards and additional information regarding game play including criteria or requirements to activate and/or play the side game shown inside game area 107. A side game paytable may also be shown through the base game help screen, through a separate help screen, or be directly viewable in the side game display area 107. In an alternative embodiment a top box display may display the respective paytables of the base game, side game, or both.

Gaming machine 100 is also shown to include middle display 113 which may display a server-based game (such as bingo, in the case of a Class II gaming machine), advertising or other content as may be provided over a network or through the gaming machine. Gaming machine 100 further includes user interface 115 with which a patron may place wagers and initiate play of one or more games at gaming machine 100. User interface 115 may include: a commercially available player tracking interface unit, such as a Bally iView™ unit, a button deck including buttons for selecting paylines and wagers per payline in the base game shown in base game area 105, one or more additional buttons for selecting wagers associated with the side game shown inside game area 107, and a "Play" button and/or handle with which the player may initiate play of the games selected by the player. The button deck may be provided on a touch panel (such as on the lower portion of display device 100) in addition to or in the alternative to a physical button deck. The "Play" button/control may be also useable to simultaneously initiate a play in the base game shown in base game display area 105 and a play in the side game shown inside game area 107. The "Play" button/control may also or alternatively be operable to separately initiate play of the side game in side game display area 107 if the option is provided to play only the side game. The player tracking unit may include a card reader 121, a ticket printer/reader (and/or bill acceptor) 119, and player display which may display a greeting to the player, player points, a menu for communicating with player account (and/or tracking) server 409, and other casino operator content.

White gaming machine 100 is shown as an upright gaming machine cabinet style, various cabinet styles or device types may be utilized including a slant top cabinet style, a bar top cabinet style (where the cabinet may be part of a bar/table top and/or housed therein), a personal computer, or, a tablet, cell phone or other handheld device.

As in the reel games shown in the figures, each reel includes a series of symbols 117 viewable on display device 100 (e.g. through a glass window or transparent display, in the case of mechanical reels, or, as displayed in a video format). With the reels in a stationary position, the symbols visible on display device 100 represent an array of symbols through which various paylines may be defined. During a wagering game (as may be initiated by a player by placing a wager and pressing a "Play" button), the reels may be simulated to spin (or electro-mechanically spun in the case of mechanical reels) about an axle under the control of a game processor which randomly or pseudo-randomly determines the game outcome and causes the reels to stop in accordance with the determined game outcome. Alternatively, a game processor may randomly or pseudo-randomly stop the reels and then evaluate the displayed symbols in light of the applicable paytable to identify the reel-type game outcome. Further alternatives in providing outcomes for the reel-type base game and side game will be described further below.

One or more paylines, combinations, or patterns of the symbols including those visible in display 100 may be correlated to a game result payable in accordance with a paytable such as may be displayed with respect to base game shown in base game display area 105. For example, a game with five reels and displaying four symbol locations per reel may have four paylines which extend horizontally across each reel and many others which may zig and zag across the various reel symbol locations both on and off the viewable display area. A patron may wager on one or more of the paylines during each game play. Display device 100 may thereby be used to display game results to one or more patrons who may view gaming machine 100 and the game processor may make payment to the patron by incrementing a credit meter for winning outcomes of paylines in accordance with the paytable and the player's wager. In example, gaming machine 100, only one payline may be provided horizontally across the three reels 103, and a player may be provided the option to bet one, two, or three credits on the payline to play the base game in base game display area 105, and a fourth or additional credits to the play side game displayed in side game display area 107. While example gaming machine 100 includes a set of three reels 103, various numbers of reels and paylines may be selected or utilized in an implementation of one or more embodiments, such as one, two, three, four, five, six or seven reels, and so forth.

Primary display device 100 may comprise a single display device or may comprise two or more display devices (for example, two flat panel display devices in over- or underlaying relation to each other, or in a side-by-side arrangement). In some implementations, primary display device 100 may comprise a touch-sensitive display panel, such as a flat panel LCD or LED display, which may be programmed to display an opaque or thematic frame image (which may include video and/or still images) except over a reel display area. Primary display device 100 may be programmed to be transparent or translucent during game play of the primary wagering game, so that the patron may view the game presentation in the reel display area where a set of mechanical reels may be viewable or a set of video reels may be displayed by an underlying display. In addition, the entire display surface of primary display device 100 (or a portion thereof) may be configured to respond to the patron's touch such as to select paylines, select credits wagered per payline, and/or play the base game and/or side game.

In one or more alternative embodiments, primary display device 100 may be programmed to display a bonus or feature game, such as may be triggered by the appearance of one or more special symbols or other random event. For example, when, a bonus or feature game is triggered, primary display device 100 (or a portion thereof) may be transformed to display content associated with the bonus or feature game and once the bonus or feature game is complete, primary display device 100 may revert to the primary game display state. A touch sensitive portion of display device 100 may be programmed to display player interactive elements such as, for example, a selection of buttons to enable player interactivity with the game. In particular, a player may use such touch screen portion to select the button or item in order to cause the game to perform additional steps and/or provide one or more bonus or feature game outcomes and awards to the player.

In one or more alternative embodiments, gaming machine 100 may include mechanical reels with fixed or dynamic symbols. Conventionally, mechanical reels include reel strips with fixed symbols. However, reel strips may be implemented using FOLED (flexible organic LED), for example, or comparable reel strips wherein one or more symbols may be programmed dynamically to vary the symbol and/or its appearance, either from one fixed image to another (such as changing a symbol to a wild symbol or changing a series of symbols to wild symbols), or, from a fixed image to a dynamic (e.g. animated or video) image or a set of miniature video reels. In various instances when a symbol changes to another symbol, a bonus or enhanced award may be paid in accordance with the paytable, or a bonus (a fixed or progressive amount) may be paid separate from the paytable.

In the event that the payment is a progressive, a progressive pool may be generated from an operator's marketing dollars or from play at one or more gaming machines which may be eligible for the progressive award. The progressive pool may be maintained by a progressive server (such as server 407 shown in FIG. 4). In cases when a progressive prize is associated with an individual gaming device, the progressive pool may be maintained through a processor (such as the game processor) associated with the gaming device. In cases when the progressive associated with a game is personal to the player, the amount of the progressive award may be maintained by a processor associated with the game while the player is playing the particular device, and when the player's gaming session ends, the amount accumulated towards the personal, progressive award, if not won, may be forwarded to a server, such as player tracking server 409 or server 421 in FIG. 4, which may forward the information to a subsequent device when the player returns to play or selects another gaming machine on which to play.

Additionally, some embodiments may include a side game trigger in the primary game; for example, the game processor may randomly or pseudo-randomly trigger one or more plays of the side game in addition to the play initialed by the side game wager. The trigger may be part of or independent of abase game outcome. Another trigger mechanism may be a countdown where a counter may be reset to a predetermined value after each triggering event; alternatively, the processor may increment a counter to a threshold value in order to trigger the one or more side game free plays. The one or more side game free plays may be a set number or may be randomly determined as part of the triggering event.

In one or more embodiments, the appearance of one or more special symbols in the base game shown in base game display area 105 may trigger a free play of one of the available side games. In one or more embodiments, the free play may be for the side game shown in game display area 107 at the time of the award; in other embodiments, the free play may be for any of the available side games on gaming machine 100 and selectable by the player; in some embodiments, the free play may be specific to an identified side game, such as by a random determination of the game processor. Each or one of the free game options may be implemented through coding executable by the game processor and once each free game is played, the game processor may be configured to provide an award according to the standard or to a modified paytable, such as one for which a multiplier has been activated.

In one or more embodiments, the side game paytable may be modified to provide an interactive element with the base game. For example, a multiplier symbol may appear on a winning payline or as a scatter symbol in the base game shown in base game display area 105, which may trigger the side game shown inside game display area 107 to modify one or more awards with a multiplier value (e.g. 1×, 2×, 3×, etc.). Alternatively or additionally, one or more free base game spins may provide a game presentation and outcome, and based on the outcome, an associated multiplier award may be applied to one or more paylines on the base game to determine the award that is paid to the player (e.g. credited to a credit meter on the gaming machine), which may be based on the currently displayed outcome and/or one or more subsequent base game plays. If two or more multiplier symbols appear in the base game, the multipliers associated with the side game paytable may be multiplied by two or more. In another example, one or more free spin symbols may appear in the base game which may trigger the side game to modify one or more awards in its paytable to include a number of free spins and depending on the side game outcome, the associated number of free spins may be applied to the base game. The associated number may be multiplied by the number of free spin symbols that appeared in the base game to trigger the side game, and the side game process may be repeated to add to the number of remaining base game free reel spins, if one or more free spin symbols appear on subsequent base game plays.

In one or more embodiments, a multiplier or number of free spins, as described above, may be saved for use at a later time in the gaming session or if the player doesn't use the multiplier or number of free spins during the gaming session, the multiplier and free spin information may be transmitted to a server (such as player tracking server 409 or gaming website 421 shown in FIG. 4), stored, and then transmitted from the server to a gaming device selected by the player at a later time. For example, the player may enter a player card into a gaming device card reader, which then communicates with player tracking server 409 or gaming website server 421 to receive player information including any saved game information. In one or more embodiments, the multiplier and free spins may be used with the same game as previously played or, in some cases, may be used with one or more other games (such as games of the same denomination). In one or more embodiments, saved multipliers and/or free spins may be increased such as by hitting a multiplier or free spin win additional times. For example, a player may win a 2× multiplier on a first win and subsequently win a 3× multiplier on a second win. The player may be able to then play a game with the 2× multiplier and play another game with the 3× multiplier. Alternatively, the multipliers may accumulate (for example, 2×+3×=5×) and the player may play a single game with a 5× multiplier. In one or more embodiments, the player may be provided the option to split up the multipliers in two or more games or play the multipliers in a single game. In a case when a player has accumulated multipliers totaling 6× or more, the player may have the option to split the multipliers into two games (for example, 2×, 4× or 3×, 3×) or three games (for example 2×, 2×, 2×) or to play the accumulated multiplier in a single game.

In one or more alternative embodiments, overlapping display panels may be implemented to generate video or display effects over the primary game reels. For example, the reel display area may be implemented as a transmissive (e.g. Aruze or WMS transmissive display panels) display or a transparent (e.g. Bally transparent display panels) display configured to display visual effects together (or cooperatively) with the primary reels under the control of the game processor during the operation of a wagering game. In the case of virtual reels, the virtual reels may be recessed a distance from, an overlaying display and segregated by dividers similar to dividers separating mechanical reels, which may provide a spatial characteristic (e.g. IGT PureDepth® display panels). In either case, the overlapping display may be touch sensitive and configured to interact with the player by transmitting and receiving signals as described above.

In one or more embodiments, the game processor operating the wagering game and interacting with various peripheral components in many instances is implemented as a microprocessor, such as an Intel Pentium® or Core® microprocessor, on a printed circuit board including one or more memory devices positioned within gaming machine 100. In alternative implementations, the game processor may be remote from gaming machine 100, such as on a server network (game server 403 shown in FIG. 4 for example) connected to gaming machine 100, in which case the game operation as described herein may be accomplished through network communications to control the display of the game on gaming machine 100.

Gaming machine 100 generally includes a CPU or game processor, memory with wagering game/s, user interface 115, network controller, audio controller, graphics processors, and reel assembly. The reel assembly will be included in gaming machine 100 if the gaming machine employs mechanical reels rather than or in addition to video-generated reels. Game processor in this example implementation may comprise a conventional microprocessor, such as an Intel Pentium® or Core® microprocessor, mounted on a printed circuit board with supporting ports, drivers, memory, and coding to communicate with and control gaming machine operations, such as through the execution of coding stored in memory including one or more wagering games. Game processor connects to user interface 115 such that a player may enter input information and game processor may respond according to its programming, such as to apply a wager and initiate execution of a game.

Game processor also may connect through network controller to a gaming network, such as example casino server network 400 which will be described below in connection with FIG. 4. Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

Generally, activity at gaming machine 100 is initiated by a player inserting currency and/or a player card into an appropriate receiving device such as a bill acceptor for currency and card reader for the player card. Upon insertion, a signal is sent to game processor. In the case of the insertion of a player card, card reader 121 transmits card information which is directed through network controller to player tracking server 409 connected to the network in which gaming machine 100 is included. Player data is transmitted to gaming machine 100 and, responsive to the data, game processor may execute coding causing player data and a display command to be transmitted to one of the graphics processors instructing the graphics processors to cause player information to be displayed on a respective display. Game processor may also transmit commands to audio controller to direct the controller to cause an audio greeting to be produced through one or more speakers associated with the gaming machine. Concurrently, the bill acceptor 119 sends a signal to game processor which may include an identification of the currency that has been read, and game processor in accordance with its coding may convert the currency amount to credits and transmit a store and display signal to a credit meter and its associated display ("Credits", on or about primary display area 105 for example). Once credits have been associated with the credit meter, the player may select the number of paylines and credits per line that the player wishes to wager, whereupon game processor, in accordance with its program code, receives the wager information from user interface 115, transmits accounting and display information to the payline ("Lines"), credits per payline ("Bet per Line"), and total bet ("Total Bet") meters and displays of the gaming machine, transmits an update to the credit meter and display ("Credits") deducting the amount of the total bet, and initiates the wagering game.

In the case of a Class III gaming devices, when a game is initiated, a random number generator (RNG) may be operated by game processor to determine the game outcome (either directly or by randomly selecting reel stop positions and evaluating those positions to identify an outcome). Commonly, game processor is positioned within gaming machine 100 and configured to manage the operation of the gaming machine components; however, the game processor may be either onboard or external to a gaming device played by a player, such as an electronic tablet (e.g. Apple iPad® or gaming specific tablet), personal data assistant (PDA), cellular telephone (e.g. Blackberry® or Apple iPhone®), surface table (e.g. Microsoft®/IGT® touch sensitive gaming surface table), etc. In such case, when the player places a wager and initiates play of the game through user interface 115 of the gaming device, the game processor may be onboard the device or remotely located such as within a network gaming server. In the latter case, an onboard microprocessor, controller, or digital signal processor may execute coding to transmit the wager and game request information through the network, and the remote game processor may operate an RNG to determine the game outcome.

In the case of Class II gaming devices, the overall structure of the various devices as discussed above is essentially the same with the major difference being the method of determining the game outcome. Commonly, Class II gaming devices utilize the game of bingo as the basis for determining a winning outcome where the ball draw is performed remotely by a network or central determination server (alternative games may be used for determining game outcomes, such as through a lottery drawing of a finite set of numbers, if permitted by the licensing jurisdiction). Class II gaming systems are commonly referred to a central determination systems wherein pools and sub-pools of game outcomes are determined by a central server (or gaming device) and distributed amongst a set of networked gaming devices. The distribution step may be on demand, such as when a gaming device receives a game request, or sets of game outcomes may be distributed to the various networked gaming devices in which case the game processor of the requesting gaming device may select a game outcome from the set of game outcomes, such as by using an RNG or other selection process.

Additionally, Class II gaming devices, such as a bingo-based gaming device may have multiple displays, such as are shown in FIG. 1 wherein one of the displays, such as display 113 in FIG. 1, may be used to display one or more electronic bingo cards and one or more ball drawings after a game has been initiated in accordance with the game outcome that has been provided to the gaming device by a central determination server. In the case, as in FIG. 1, where the primary display comprises a set of reels, game processor converts the centrally-determined game outcome to a corresponding value outcome of the reel-based game as shown in FIG. 1 and operates the reel-based game as described above and with respect to the figures. In one or more embodiments, when a player enters a wager on both the base game 103 and side game 105 described above, and enters "PLAY" through an appropriate player control, a game play request may be transferred to central determination server 405 (discussed below in connection with FIG. 4) which may provide a single game outcome to the respective gaming machine 100. Game processor may then initiate game presentations of both games concluding with outcomes corresponding to the game outcome provided by central determination server 405. In an alternative embodiment, central determination server 405 may provide two game outcomes (one associated with base game 103 and one associated with side game 105), and game processor may initiate corresponding game presentations of base game 103 and side game 105.

In one or more embodiments, coding may be implemented and stored in memory, executable by game processor to control game operation, display content, lighting, and audio through video, audio, reel drive motor controllers (for mechanical reels), and lighting controllers.

While she primary display has been depicted as displaying a set of reels, in one or more base game embodiments, base game 103 may comprise other types of games. For example, base game 103 may comprise a playing card-based game such as poker or blackjack, a dice-based game such as craps or a hoard game such as the Monopoly® game, a wheel-based game such as roulette or Wheel-of-Fortune® type prize wheel, or a competition-based game such as a ear or horse race.

Also, while gaming machine 100 has been described as a stand-alone or networked game device, in one or more embodiments gaming machine 100 may be operable in a tournament or community gaming mode wherein players may compete for one or more awards or triggering of special features. For example, in one or more example configurations, one or more banks of gaming machines 100 may be networked connected to an overhead display which may display a feature game and when triggered, the player triggering the feature game may be indicated on the overhead display as the wheel-based game is played. In another example, side game 105 may be played conventionally with payouts according to the side game paytable and players who are linked in a community game may compete against each other during each play for additional awards. For example, of the competing players during a predetermined period of time (e.g. ten minutes), the player with the highest cumulative awards on a selected base or side game may receive a first award and a player with the second highest cumulative awards may receive a second award. In one or more embodiments, the additional awards may be credited to the gaming machine 100 of the respective players; while in other embodiments, the additional awards may be credited to player accounts on player account server 409. In one or more embodiments, selected of the side game outcomes and respective player identifiers may be displayed on an overhead screen along with the awards paid to each participating player. In one or more embodiments, the participating players may be required to pay an additional fee to participate. For example, a network inquiry to play in the community game may be made on a player tracking display from a server, such as player account server 409 or a community game server. If the player accepts the invitation for the community game, the player's account or gaming device credit meter may be debited accordingly. A community game controller may transmit a message to each participating player advising of their participation. In one or more embodiments, a player's highest side game individual award or cumulative awards occurring during a selected time span may be used by the community game controller as the players entry into the community competition or tournament. Base game 103 may be used as opposed to side game 105 for the community game and the same concepts may be applied as described above. Additionally, advertising of the community event may be displayed on one or more of the overhead displays and gaming machine 100 displays to notify players of the timing to begin play, such as by displaying a countdown timer and a community game notice and/or icon.

Figure 4:
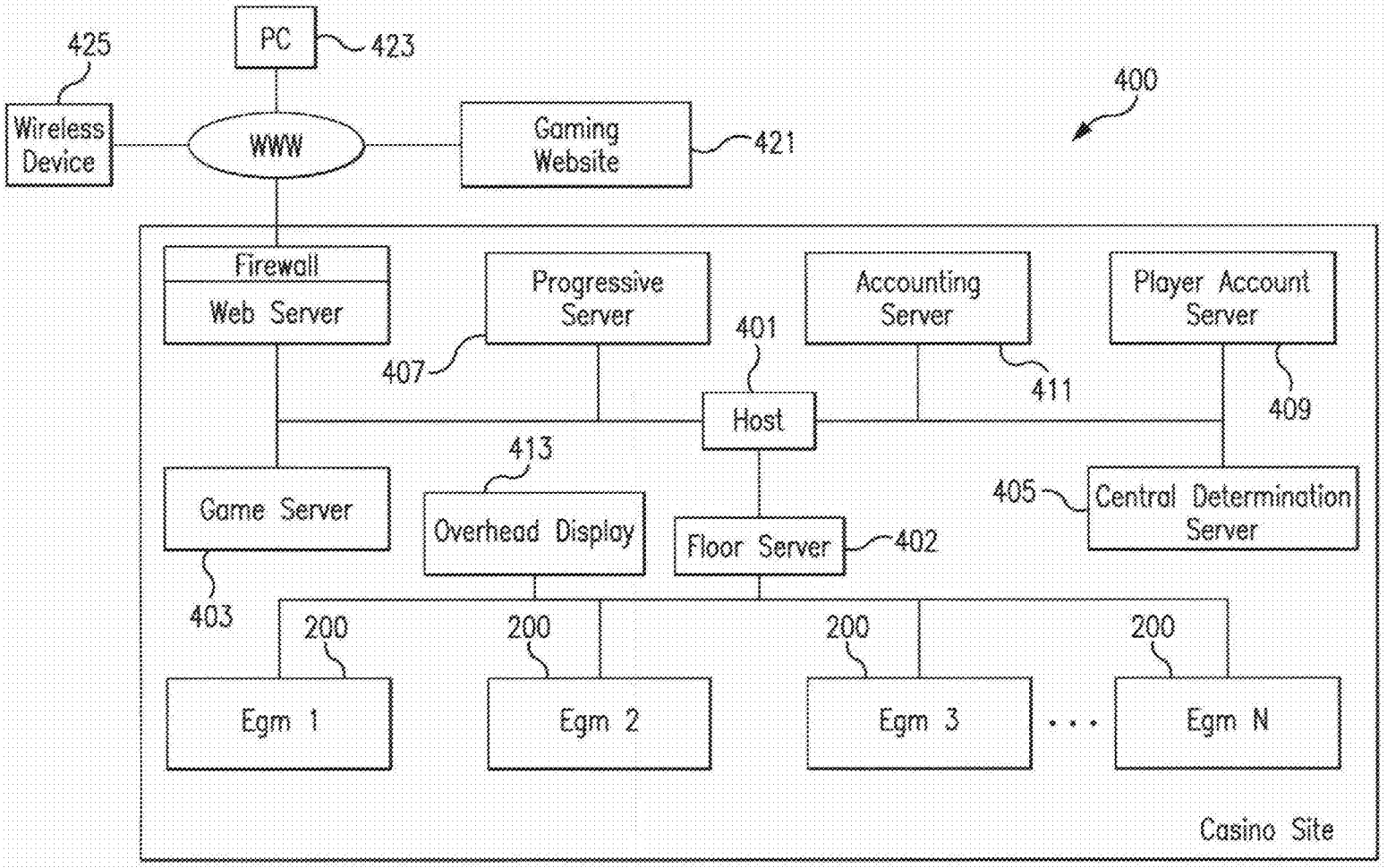
FIG. 4 is a diagrammatic representation of an example gaming network including one or more gaming machines with dual game play in accordance with one or more embodiments.

Referring to FIG. 4, a block diagram of example networked gaming system 400 associated with one or more gaming facilities is shown including one or more gaming machines 100 connected in a network with host server 401 and floor server 402. One or more of the gaming machines 100 may provide a base game 103 and side game 105 as discussed above. While a few servers have been shown separately in FIG. 4, it will be appreciated that the servers may be combined or split into additional servers having additional capabilities.

As shown, networked gaming machines 100 (Egm 1-Egm N) and one or more overhead displays 413 may be network connected so as to enable the content of one or more displays of gaming machines 100 to be mirrored or replayed on overhead display. For example, the primary display content may be stored by the display controller or game processor and transmitted through a network controller to the overhead display controller either substantially simultaneously or at a subsequent time according to either programming executed by the game processor or a triggering event, such as a jackpot or large win, at a respective gaming machine 100. In the event that gaming machines 100 have cameras installed, the respective players' video images may be displayed on overhead display 413 along with the content of the player's display 100 and any associated audio feed.

Game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event such as a progressive jackpot game outcome or other triggering event such as a random or pseudo-random win determination at a networked gaming device or server (to provide a large potential award to players playing the community feature game for example). Accounting server 411 may receive gaming data from each of the networked gaming devices, perform audit functions, and provide data for analysis programs, such as the IGT Mariposa™ program bundle. Central determination server 405 may be configured to determine lottery, bingo, or other centrally determined game outcomes and provide the information to networked gaming machines 100 providing lottery and bingo-based wagering games to patrons.

Player account server 409 may maintain player account records, and store persistent player data such as accumulated player points and/or player preferences such as game personalizing selections or options. For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card is inserted, an identification code may be read from the card and transmitted to player account server 409. Player account server 409 may then cause player information to be transmitted through a network controller for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor for storing and use during the player's game play. Also, the player's selection may be transmitted to player account server 409 where it may be stored in association with the player's account for transmission to the player in future gaming sessions. The player may change selections at any time using the player tracking display at the gaming machine (which may be touch sensitive or have player-selectable buttons associated with the various display selections).

In one or more embodiments, a gaming website 421 may be accessible to players to allow players to play one or more games as described, herein through the use of personal, computer 423 or handheld wireless device 425 (e.g. Blackberry® cell phone, Apple Iphone®, personal data assistant (PDA), iPad®, etc.). To enter the website, a player may log in with a user name (that may be associated with the player's account information stored on player account server 409 or be accessible by a casino operator to obtain player data and provide promotional offers). Once logged in, the player may play various games on the website. The play may also use the website to make various personalizing selections and save the information so that during a next gaming session at a casino establishment the players playing data and personalized information may be associated with the players account and accessible at the player's selected gaming machine 100. Additionally, during game play at a gaming machine 100 at a casino site various prayer preferences may be transmitted and stored on the gaining website 421 and then the stored information may be transmitted to a respective gaming machine 100 at a later time when the player is identified.

In one or more embodiments, a method is presented for operating a player-selectable dual or multi-wagering game wherein a player may be provided the opportunity to select one or more side games from a set or available side games at a given gaming machine 100. Responsive to a side game player selection, the game processor may cause a display device, such as display 101 to show the one or mom selected side games. Prior to selecting the one or more side games, the player may receive an option to view a sample play of the one or more selectable side games, such as by the game processor providing a side game sample display button on one of the available displays which may be activated by a player action, such as pressing a touch sensitive area associated with the side game sample display button. One or more base games may be displayed on gaming machine 100, whereon the base games and selected side games are operable simultaneously through one or more game processors. Responsive to a game initiation action by the player, the one or more game processors randomly or pseudo-randomly determine the base game and side game outcomes; and award any prizes or awards associated with winning game outcomes. On one of the displays, a set of side game representations may be shown, wherein each side game representation corresponds to a respective side game and each side game representation may be selected such as by the player pressing a touch screen area associated with a given side game representation. Responsive thereto, the game processor may then display the one or more selected side games. After the player has selected the one or more selected side games, the set of side game representations may be replaced by a display of the selected side games. Additionally, the set of game representations may be minimized to a portion of one of the displays, such as by removing the set from view and displaying a side game set icon, when the Selected side games are displayed. The side game set icon may be activated, such as by the player pressing a touch sensitive area associated with the icon, to restore the set of side game representations and enable the player to reselect and/or de-select one or more side games.

In one or more embodiments, the method of operating a player-selectable dual or multi-wagering game may include displaying a set of base game representations where each base game representation corresponds to a respective base game; and, displaying the base games responsive to a selection by the player of one or more of the base game representations. Responsive to the player's selection, the game processor replaces the displayed set of base game representations with the display of at least one of the selected base games. The processor may also cause the displayed set of base game representations to be minimized when at least one of the selected base games is displayed; and, responsive to a base game restore action by the player, the game processor may restore the displayed set of base game representations so that the player may make one or more selections and/or de-selections. When the set of base game representations are minimized, a base-game set icon corresponding to the set of base game representations, may be displayed in or about a touch sensitive area to enable the player to restore the set of base game representations and engage in the selection process. After making the selections of base and/or side games, the player may place a wager as through a 'Bet' button and initiate play of the games by pressing a 'Play' button each of which produce signals recognized by the game processor for the purposes of evaluating a subsequent game outcome and awards thereto where the awards are paid in accordance with a paytable that conventionally increments depending upon the number of credits wagered per line.

In one or more embodiments, the method of operating a player-selectable dual or multi-wagering game may include transmitting a player preference signal to a player account server, such as player tracking server 409 or gaming website/server 421. The player preference signal includes information identifying the player and the selected side and/or base games which may then be stored in a memory accessible by the server for transmission to the player's gaming device during or upon initiation of a subsequent gaming session. When the player enters identification information, such as by inserting a player card into the card reader at a gaming device, the gaming device may send a request to the player account server to obtain any player preference information. Responsive to the request for the player preference information, the server may access an accessible database with the player records to obtain and transmit the player preference information to the requesting gaming device. After receipt, the gaming device may display one or more games on the gaming device in accordance with the player preference information. Prior to displaying one or more games in accordance with the player preference information, the gaming device may display a request asking the player whether to use the player preference information to display the one or more games; and, after receiving an acknowledgement (acceptance) from the player, the gaming device may then display the one or more games.

Referring generally to the forgoing description and the following claims, as used herein the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "presentation" as used herein is meant to refer to the display of any image and/or video performance and/or the performance of one or more sound bites or audio tracks (such as digital or analog sound tracks or information stored on a memory device and processed by an audio controller to emit sound through a speaker) whether in an attract mode or as part of a game presentation or outcome.

The above described example embodiments are intended to illustrate the principles of the invention, but not to limit the scope of the invention. Various other embodiments and modifications to these preferred embodiments may be made by those skilled in the art without departing from the scope of the present invention. In another example, one of the base game and side game may be determinable by one processor (e.g. a local processor) and the other game may be determinable by another processor (e.g. a remote processor) while one of the processors or another processor may drive a presentation to be displayed on a primary display of gaming machine 100 including the base game and side game and culminating in outcomes according to the determinations.

In addition to the variations described above, the following variations also apply to the side game arrangement disclosed herein. For example in one or more embodiments, the more a player plays the side game (such as in one or possibly more sessions of play) the easier winning the biggest prize gets or the bigger the awards get. That is, the paytable and the probabilities associated with each award level may change depending upon how many times the side game is played in a given gaming session and/or multiple gaming sessions by a player. The side game could be linked with other side games provided at different gaming machines and may pay progressive or mystery awards. The player may decide to remove side action completely from the screen, or they could elect to add side games to their primary game. A side game may include a pop-n-win type game feature where a balloon (or something similar) appears in the side game area during the course of the base and/or side game and the player has to do something to win the bonus or prize for the game, such as popping (tapping the screen image of) a video-generated balloon. The side game could be connected to overhead signage and the results could be broadcasted on the bigger display or used for progressives. The live cameras on the gaming machines could be used within the side game. For example, a side game could display camera feeds showing players in the gaming network. The side game could be added on a second or other display device rather than the display used to show the base game. For example, the side game could be shown on a topbox display of the gaming machine, or a side game could be on a display next to or overlaying mechanical reels. In other embodiments, a certain percentage of money played on the base game is accrued and can be used for awards in the side action game or games. Also, in some instances, the amount of the side wager for the side game may be selectable by the player so that the paytable awards may be increased and/or the likelihood of winning outcomes is increased.

The invention claimed is:

1. A method for operating a player-selectable dual wagering game, the method including:

displaying a set of side game representations, each side game representation corresponding to a respective side game, enabling and receiving a side game player selection input from a player comprising selecting one or more of the side game representations;

responsive to the side game player selection, displaying one or more selected side games;

displaying one or more base games, the base games and selected side games being operable simultaneously through one or more game processors; responsive to a game initiation action by the player, randomly or pseudo-randomly determining the base game and side game outcomes; and awarding any prize or award associated with winning game outcomes.

2. The method of claim 1, the step displaying the selected side games including: replacing the displayed set of side game representations with the display of at least one of the selected side games.

3. The method of claim 1, the step displaying the selected side games including:

minimizing the displayed set of side game representations when at least one of the selected side games is displayed; responsive to a side game restore action by the player, restoring the displayed set of side game representations.

4. The method of claim 3, the step minimizing the displayed set of side game representations including:

displaying a side game set icon corresponding to the set of side game representations; the method wherein the side game restore action comprises the player selecting the side game set icon.

5. The method of claim 1, the step displaying one or more base games including:

displaying a set of base game representations, each base game representation corresponding to a respective base game; and displaying the base games responsive to a base game player selection of one or more of the base game representations.

6. The method of claim 5, the step displaying one or more base games including:

replacing the displayed set of base game representations with the display of at least one of the selected base games.

7. The method of claim 5, the step displaying the selected base games including:

minimizing the displayed set of base game representations when at least one of the selected base games is displayed;

responsive to a base game restore action by the player, restoring the displayed set of base game representations.

8. The method of claim 7, the step minimizing the displayed set of base game representations including:

displaying a base game set icon corresponding to the set of base game representations;

the method wherein the base game restore action comprises the player selecting the base game set icon.

9. The method of claim 1, the step of randomly determining including:

accepting a wager by a player to initiate each of the base games and the selected side games, the game initiation action including initiating the wager; and the awarding step including paying each of the awards or prizes in accordance with the wager.

10. The method of claim 1 wherein the base game and side game outcomes and the prize opportunities are determined independently.

11. The method of claim 1 including:

responsive to a triggering event, initiating one or more free plays of one or more side games.

12. A method for operating a player-selectable dual wagering game, the method including:

responsive to a side game player selection, displaying one or more selected side games;

displaying one or more base games, the base games and selected side games being operable simultaneously through one or more game processors;

responsive to a game initiation action by the player, randomly or pseudo-randomly determining the base game and side game outcomes;

awarding any prize or award associated with winning game outcomes;

transmitting a player preference signal to a player account server, the player preference signal including information identifying the player and the selected side game; and storing the player preference information in a location accessible during a subsequent gaming session.

13. The method of claim 12 including:

responsive to a player submitting identification information at a gaming device, requesting the player preference information.

14. The method of claim 13 including:

responsive to the request for the player preference information, receiving the player preference information at the gaming device; and displaying one or more games on the gaming device in accordance with the player preference information.

15. The method of claim 14 including:

prior to displaying one or more games in accordance with the player preference information;

displaying a request to use the player preference information to display the one or more games; and receiving a player acknowledgement to display the one or more games.

16. The method of claim 14 including:

prior to displaying one or more games in accordance with the player preference information;

displaying a request to use the player preference information to display the one or more games; and receiving a player acknowledgement to display the one or more games.

17. The method of claim 13 including:

responsive to the request for the player preference information, receiving the player preference information at the gaming device; and displaying one or more games on the gaming device in accordance with the player preference information.

18. The method of claim 12, wherein:

the step displaying one or more base games further includes:

displaying a set of base game representations, each base game representation corresponding to a respective base game; and displaying the base games responsive to a base game player selection of one or more of the base game representations.

19. The method of claim 12 including:

responsive to a player submitting identification information at a gaming device, requesting the player preference information.

* * * * *